US007676997B1

(12) United States Patent
Sorkin

(10) Patent No.: US 7,676,997 B1
(45) Date of Patent: Mar. 16, 2010

(54) TENDON TENSIONING ANCHOR SYSTEM HAVING POLYMERIC ENCAPSULATION WITH REDUCED SHRINKAGE EFFECTS

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 501 days.

(21) Appl. No.: 11/274,934

(22) Filed: Nov. 15, 2005

(51) Int. Cl.
*E04C 5/08* (2006.01)
*E04C 5/12* (2006.01)

(52) U.S. Cl. ..... 52/223.13

(58) Field of Classification Search ..... 52/223.13, 52/223.14; 264/267, 273–275
See application file for complete search history.

(56) References Cited

U.S. PATENT DOCUMENTS 3,293,811 A * 12/1966 Rice ..... 52/223.13
3,328,500 A * 6/1967 Barnette ..... 264/108
4,348,844 A * 9/1982 Schupack et al. ..... 52/223.13
4,351,869 A * 9/1982 Cresap ..... 428/121
4,616,458 A * 10/1986 Davis et al. ..... 52/223.13
4,676,041 A * 6/1987 Ford ..... 52/309.11
4,719,658 A * 1/1988 Kriofske ..... 52/223.13
4,896,470 A * 1/1990 Sorkin ..... 52/223.13
5,072,558 A * 12/1991 Sorkin et al. ..... 52/223.13
6,380,508 B1 * 4/2002 Sorkin ..... 219/121.39
6,513,287 B1 * 2/2003 Sorkin ..... 52/223.13
6,883,280 B2 * 4/2005 Hayes ..... 52/223.13

* cited by examiner

*Primary Examiner*—Michael Safavi
(74) *Attorney, Agent, or Firm*—Egbert Law Offices PLLC

(57) ABSTRACT

A tendon tensioning anchor has a base member having a tubular section extending therefrom, and a pair of flanges extending outwardly on opposite sides of the tubular section, and a polymeric encapsulation in generally air-tight juxtaposition with an exterior of the base member. A hole is formed through each of the pair of flanges. The polymeric encapsulation extends entirely through and fills the holes so as to integrally connect the polymeric material overlying one surface of the flange with the polymeric material overlying an opposite surface of the flange. The hole is formed adjacent to the tubular section.

7 Claims, 3 Drawing Sheets

TENDON TENSIONING ANCHOR SYSTEM HAVING POLYMERIC ENCAPSULATION WITH REDUCED SHRINKAGE EFFECTS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to tendon tensioning anchors. More particularly, the present invention relates to tendon tensioning anchors that have a polymeric encapsulation extending thereover so as to seal exterior surfaces of the anchor from the environment.

BACKGROUND OF THE INVENTION

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive (vertical) load, is extremely weak in carrying significant tensile loads. It becomes necessary, therefore, to add steel bars, called reinforcements, to concrete, thus allowing the concrete to carry the compressive forces and the steel to carry the tensile (horizontal) forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as 100 feet can be attained in members as deep as three feet for roof loads. The basic principal is simple. In prestressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principal, but the reinforcing is held loosely in place while the concrete is placed around it. The reinforcing is then stretched by hydraulic jacks and securely anchored into place. Prestressing is done with individual members in the shop and post-tensioning as part of the structure on the site.

In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

Metallic components within concrete structures may become exposed to many corrosive elements, such as de-icing chemicals, sea water, brackish water, or spray from these sources, as well as salt water. If this occurs, and the exposed portions of the anchor suffer corrosion, then the anchor may become weakened due to this corrosion. The deterioration of the anchor can cause the tendons to slip, thereby losing the compressive effects on the structure, or the anchor can fracture. In addition, the large volume of byproducts from the corrosive reaction is often sufficient to fracture the surrounding structure. These elements and problems can be sufficient so as to cause a premature failure of the post-tensioning system and a deterioration of the structure.

Several U.S. patents have considered the problem of anchor and tendon corrosion. U.S. Pat. No. 4,348,844, issued to Morris Schupack et al., on Sep. 14, 1982, disclosed a tendon assembly in which a tendon is enclosed in a sheath suspended under tension between two spaced anchor members. The anchor members are entirely enclosed within an envelope or a housing. The sheath, the envelope, and the housing are required to comprise electrically non-conductive materials for electrically isolating the tendon and anchor members from a surrounding concrete structure to thereby prevent the effects of electrolysis caused by electrical currents.

U.S. Pat. No. 4,616,458, issued to Davis et al., on Oct. 14, 1986, provided a plastic structure for protecting the anchor assembly and the ends of a tendon from exposure to the corrosive elements. The system of this patent describes a protective top member and a protective bottom member. The anchor was interposed between these members, the members were snap-fitted together, and the anchor locked into position between these protective members. Grease was then injected into the interior between these protective plastic members so as to seal the anchor from the corrosive water in the environment. A grease cap would be threaded onto the protective top member so as to allow grease to be injected into the interior space.

U.S. Pat. No. 4,896,470 issued on Jan. 30, 1990 to the present inventor, describes a tendon tensioning anchor which includes a base member having a tubular extension extending therefrom and aplastic encapsulation in generally juxtaposition with the exterior of the base member and the exterior of the tubular section. The plastic encapsulation includes a polymeric material of high density polyethylene and in injection-molded relationship to the base member and the tubular section. The encapsulation is of a unitary construction. The base member and the sloping annular interior wall of the tubular section are in contact with the tendon extending therethrough so as to establish an electrolytic contact. The tubular section has a sloping annular interior wall for receiving the end of the tendon.

U.S. Pat. No. 5,072,558, issued on Dec. 17, 1991 to the present inventor, also describes a post-tension anchor system having a similar construction to that of U.S. Pat. No. 4,896,470. U.S. Pat. No. 5,072,558 describes the use of a heat shield fastened within the polymer encapsulation adjacent an end of the tubular section that extends outwardly of the base. The polymer encapsulation includes a tubular portion formed at a side of the base member opposite the tubular section and extends outwardly perpendicular to the base member. The heat shield is a rigid member having an outer diameter corresponding to the outer diameter to the tubular section. Extension tubing is fitted to the end of the tubular section of the polymer encapsulation. A seal is fastened within the other end of the extension tubing so as to create a liquid-tight seal with a tendon passing therethrough.

FIG. 1 shows a prior art system manufactured in accordance with the teachings of U.S. Pat. Nos. 4,896,470 and 5,072,558. This system is presently sold by General Technologies, Inc., of Stafford, Tex. As can be seen in FIG. 1, the base member 10 has a polymeric encapsulation 12 extending thereover. A tubular section 14 extends outwardly of the base member 12 generally centrally thereof. Flanges 16 and 18 extend outwardly from opposite sides of the tubular section 14. The polymeric encapsulation 12 will extend around the base member 10 and over and around the tubular section 14. A pair of nail holes 20 and 22 are formed through the base member 10 so as to allow the base member 10 to be secured to an exterior surface. A cap 24 is illustrated as suitable for connection over the end 26 of tendon 28 so as to maintain the end 26 of tendon 28 in a generally air-tight and liquid-tight environment. A suitable grouting material can fill the interior of the cap 24 so as to further avoid any contaminating effects from the exterior environment as affecting the tendon 28. A tubular section 30 extends outwardly from the opposite side of the base member 10 opposite the tubular section 14. A sealing tube 32 is illustrated as positioned for friction-fit relationship to the tubular section 30. Tendon 28 will extend through the sealing tube 32. A sheathing 34 is applied over the exterior of the tendon 28 so as to further avoid corrosive effects from the exterior environment. A seal 36 engages with the sheathing 34 so as to maintain the tendon 28 in a generally liquid-tight and air-tight environment.

FIG. 2 is a cross-sectional view of the anchor system as illustrated in FIG. 1. In particular, it can be seen that the base member 10 is a steel anchor of a generally conventional configuration. The tubular section 14 has a sloping annular interior wall 38. The polymeric encapsulation 12 will extend over the surfaces of the tubular section 14 and over the flanges 16 and 18 of the base member 10. Tubular portion 30 is illustrated as extending in longitudinal alignment with the tubular section 14. The polymeric encapsulation includes a portion 40 which extends over and around the exterior of the tubular section 14 and also defines the cap-receiving receptacle 42. The polymeric encapsulation 12 is integrally formed over the base member 10 and serves to define the portion 40 and the tubular portion 32.

In use of the anchor described in FIGS. 1 and 2, it was found that a certain amount of polymeric shrinkage can occur over time. The shrinkage of polymers is a natural condition of polymers. Whenever the polymeric encapsulation 12 should shrink around the base member 10, surfaces 44 and 46 will tend to pull away from the surfaces 48 and 50 of the base member 10. When the polymeric encapsulation tends to pull away from surfaces 48 and 50, several problems can result. First, the polymeric encapsulation 12 will no longer be in surface-to-surface with the surfaces of the base member 10. As such, it is possible that air and liquid intrusion can occur into such spaces. Secondly, the forces imparted by the shrinking polymeric encapsulation 12 could potentially create sufficient forces so as to cause a fracture of the steel material used for the base member 10. This can especially be the case where a certain leverage effect is created by the force exerted by the shrinking polymer material upon the far ends of the outwardly extending flanges 16 and 18. In other words, when the polymeric encapsulation 12 should shrink, the pulling forces will extend between the tubular section 14 and the very ends of the flanges 16 and 18. As such, it is very important to be able to provide a system whereby such polymer shrinkage will not adversely affect the integrity of the post-tension anchoring system.

It is an object of the present invention to provide a post-tension anchor system which effectively avoids any adverse effects caused by polymer shrinkage.

It is another object of the present invention to provide a post-tension anchor system which maintains the polymeric encapsulation in strong surface-to-surface contact with the surfaces of the anchor.

It is a further object of the present invention to provide a post-tension anchor system which minimizes potential fractures of the steel base member.

It is a still another object of the present invention to provide a post-tension anchor system which is easy to manufacture, easy to use and relatively inexpensive.

These and other objects and advantages of the present invention will become apparent from the reading of the attached specification and appended claims.

BRIEF SUMMARY OF THE INVENTION

The present invention is a tendon tensioning anchor that comprises a base member having a tubular section extending therefrom and first and second flanges extending outwardly from opposite sides of the tubular section, and a polymeric encapsulation in generally air-tight juxtaposition with an exterior of the base member. At least one of the first and second flanges has a hole formed therethrough generally adjacent to the tubular section. The polymeric encapsulation extends through and fills the hole so as to connect the polymeric surfaces that reside on opposite sides of the flange.

The polymeric encapsulation has a first surface on one side of the flange and a second surface on an opposite side of the flange. The polymeric encapsulation connects the surfaces through the hole. In particular, a first hole is formed through the first flange on one side of the tubular section, and a second hole is formed through the second flange on an opposite side of the tubular section. The polymeric encapsulation extends entirely through and fills the first and second holes. Each of the first and second holes is adjacent the tubular section. These holes are diametrically opposite each other.

In alternative embodiment of the present invention, a third hole is formed through the first flange on one side of the tubular section in spaced relationship to the first hole and a fourth hole is formed through the second flange on the opposite side of the tubular section in spaced relationship to the second hole. The polymeric encapsulation extends entirely through and fills the third and fourth holes. The holes can be tapered so as to have a narrow diameter at the first surface and a wide diameter at the second surface.

The polymeric encapsulation has a tubular portion extending around an exterior of the tubular section. The polymeric encapsulation extends entirely through the hole so as to integrally connect with the tubular portion of polymeric encapsulation. The polymeric encapsulation is a polymeric material in injection-molded relationship which the base member. The polymeric encapsulation is of a unitary construction.

The present invention is also a method of encapsulating an anchor for use in post-tension construction. The method of the present invention includes the steps of: (1) forming a base member of a steel material which has a tubular section extending outwardly and a pair of flanges extending on opposite sides of the tubular section; (2) forming a hole through at least one of the flanges of the base member so as to extend entirely through flange; (3) placing the base member in a mold of an injection molding machine; and (4) injecting polymeric material into the mold under pressure so as to form a polymeric encapsulation around the base member and through the hole so as to fill the hole in order to integrally connect the polymeric material overlying the opposite surfaces of the flanges.

DETAILED DESCRIPTION OF THE INVENTION

Figure 3:
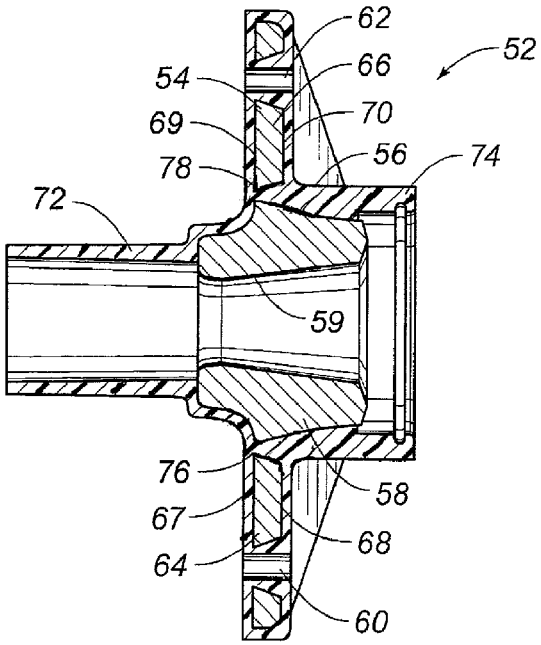
FIG. 3 is a cross-sectional view of a tendon tensioning anchor in accordance with the preferred embodiment of the present invention.

Referring to FIG. 3, there is shown the tendon tensioning anchor 52 in accordance with the preferred embodiment of the present invention. The tendon tensioning anchor 52 includes a base member 54 having a polymeric encapsulation 56 extending thereover and therearound. In particular, the base member 54 is a steel construction anchor having a tubular section 58 extending outwardly centrally thereof. The tubular section 58 has a sloping annular interior wall 59 suitable for receiving a tendon therein. The anchor 54 includes nail holes 60 and 62 formed through the respective flanges 64 and 66. Flanges 64 and 66 extend outwardly on opposite sides of the tubular section 58. Flange 64 has a first surface 67 and a second surface 68. The flange 66 has a first surface 69 and a second surface 70.

Figure 1:
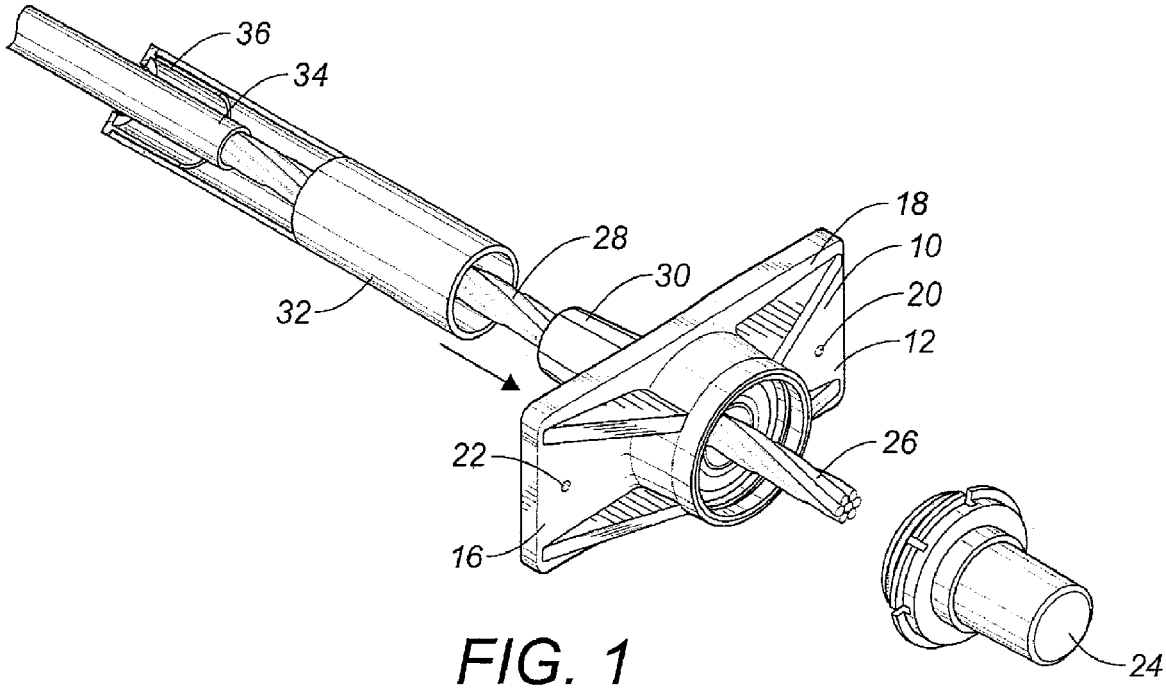
FIG. 1 Prior Art
FIG. 1 is a perspective view of a post-tension anchor system in accordance with the prior art.
Figure 2:
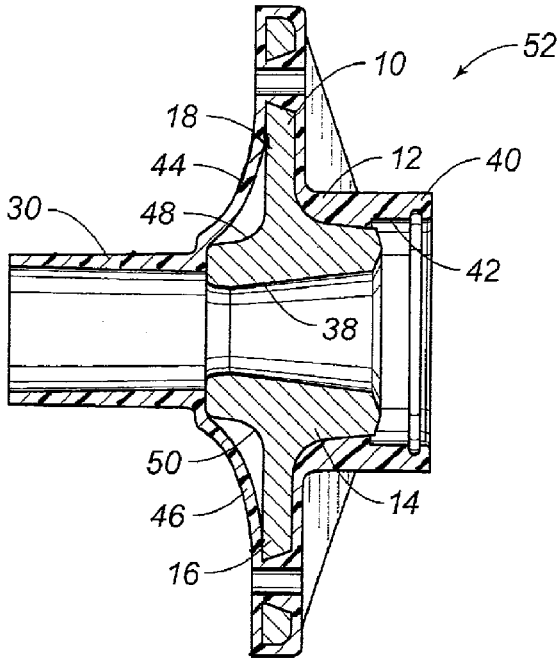
FIG. 2 Prior Art
FIG. 2 is a cross-sectional view of an anchor as used in a post-tension system of the prior art illustrating, in particular, the manner in which polymer shrinkage can affect the anchor.

The polymeric encapsulation 56 will extend over and around the tubular section 58 and over and around the flanges 64 and 66. The polymeric encapsulation will also define a tubular portion 72 extending outwardly from an opposite side of the base member 54 from the tubular section 58. The polymeric encapsulation 56 also defines a receptacle area 74 located forward of the tubular section 58. Receptacle area 74 is suitable for receiving a cap therein (similar to the cap 24 as illustrated in FIG. 1). A tendon can extend through the tubular portion 72 and through the annular interior wall 60 of the tubular section 58 in the manner described hereinbefore in association with FIGS. 1 and 2.

Importantly, in the present invention, a hole 76 is formed through the first flange 64 in close proximity to the outer wall of the tubular section 58. Another hole 78 is formed through the second flange 66 adjacent to the opposite wall of the tubular section 58. It can be seen that the polymeric encapsulation 56 extends entirely through the holes 76 and 78 and fills such holes. In particular, the polymeric encapsulation which extends through holes 76 and 78 serves to connect the polymeric material overlying the surfaces 67 and 68 of the first flange 64 and also serves to connect the polymeric encapsulation 56 overlying the side 69 and 70 of the second flange 66. Each of the holes 76 and 78 is tapered so as to have a wide diameter at the second surfaces 68 and 70 of the respective flanges 64 and 66 and a narrow diameter opening to the surfaces 67 and 69 of the flanges 64 and 66.

The extension of the polymeric material through the respective holes 76 and 78 establishes a "rivet" effect with respect to the polymer surfaces overlying the respective sides of the flanges 64 and 66. Because of this connection, it is not possible for the polymeric material to pull away from the surfaces of the base member 54 in the event of polymer shrinkage. Additionally, the positioning of the holes 76 and 78 adjacent to the tubular section 58 enhances the strength of connection therethrough. It can be seen that the polymeric material generally connects with the strong thick polymer surface of the polymer material overlying the tubular section 58. The leverage effects created in the prior art are avoided herein because the polymeric connection between the surfaces of the polymer material is coplanar between the connection adjacent the tubular section 58 and the connections adjacent the outer ends of the flanges 64 and 66. The wide diameter ends of the holes 76 and 78 maximize the amount of polymer where is needed the most, i.e. adjacent the portion of polymer material overlying the tubular section 58.

Figure 4:
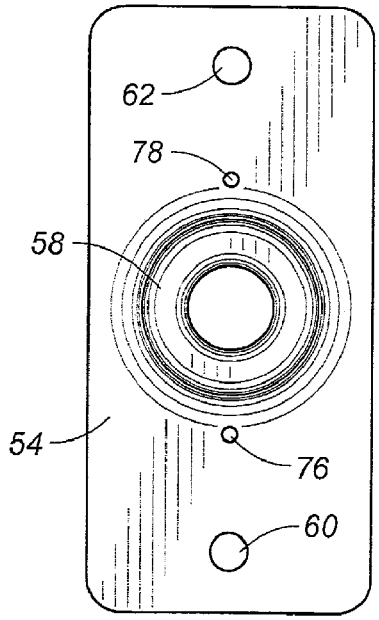
FIG. 4 is an end view showing the base member of the tendon tensioning anchor of FIG. 3.

FIG. 4 is an end view of the base member 54 as used in the anchor 52 of FIG. 3. As can be seen, the hole 76 is formed adjacent to the tubular section 58. Hole 78 is formed adjacent to the tubular section 58 opposite to the hole 76. The holes 76 and 78 are diametrically opposed to each other. Nail holes 60 and 62 are also illustrated as formed through the base member 54 in spaced relationship away from the tubular section 58.

Figure 5:
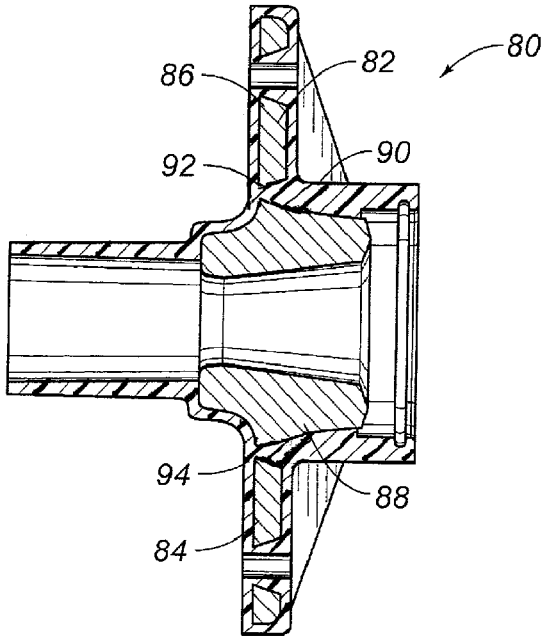
FIG. 5 is a cross-sectional view of an alternative embodiment of the tendon tensioning anchor of the present invention.
Figure 6:
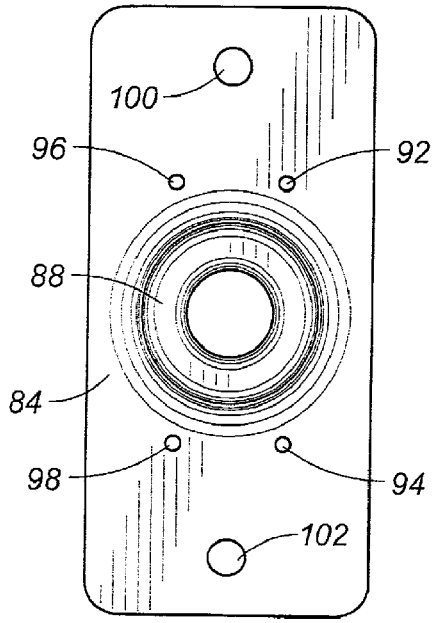
FIG. 6 is an end view of the base member as used in the alternative embodiment illustrated in FIG. 5.

FIG. 5 shows an alternative embodiment of the anchor 80 of the present invention. Anchor 80 has a similar construction to that shown in FIG. 3. However, a total of four holes are formed through the flanges 82 and 84 of base member 86. These holes are formed in close proximity to the exterior of the tubular section 88 of base member 86. As can be seen, the polymeric encapsulation 90 extends over the flanges 82 and 84 and through respective holes 92 and 94. As can be seen in FIG. 6, holes 92 and 94 are located in proximity to the tubular section 88. Additional holes 96 and 98 are also formed in proximity to the tubular section 88. Hole 96 is in spaced relationship to hole 92 on one side of the tubular section 88. Hole 98 is in spaced relationship to hole 94 on an opposite side of the tubular section 88. Nail holes 100 and 102 are illustrated as spaced away from holes 92, 94, 96 and 98 and away from the tubular section 88. In the embodiment of the anchor 80, as illustrated in FIGS. 5 and 6, the polymeric material will flow so as to entirely fill each of the holes 92, 94, 96 and 98. In this manner, an integral connection is made between the polymer material overlying the flanges 82 and 84 on opposite sides of the respective flanges. The use of four holes is believed to further distribute the forces over a wider area of the polymeric material. It may also avoid further leverage effects caused by polymer shrinkage.

Figure 7:
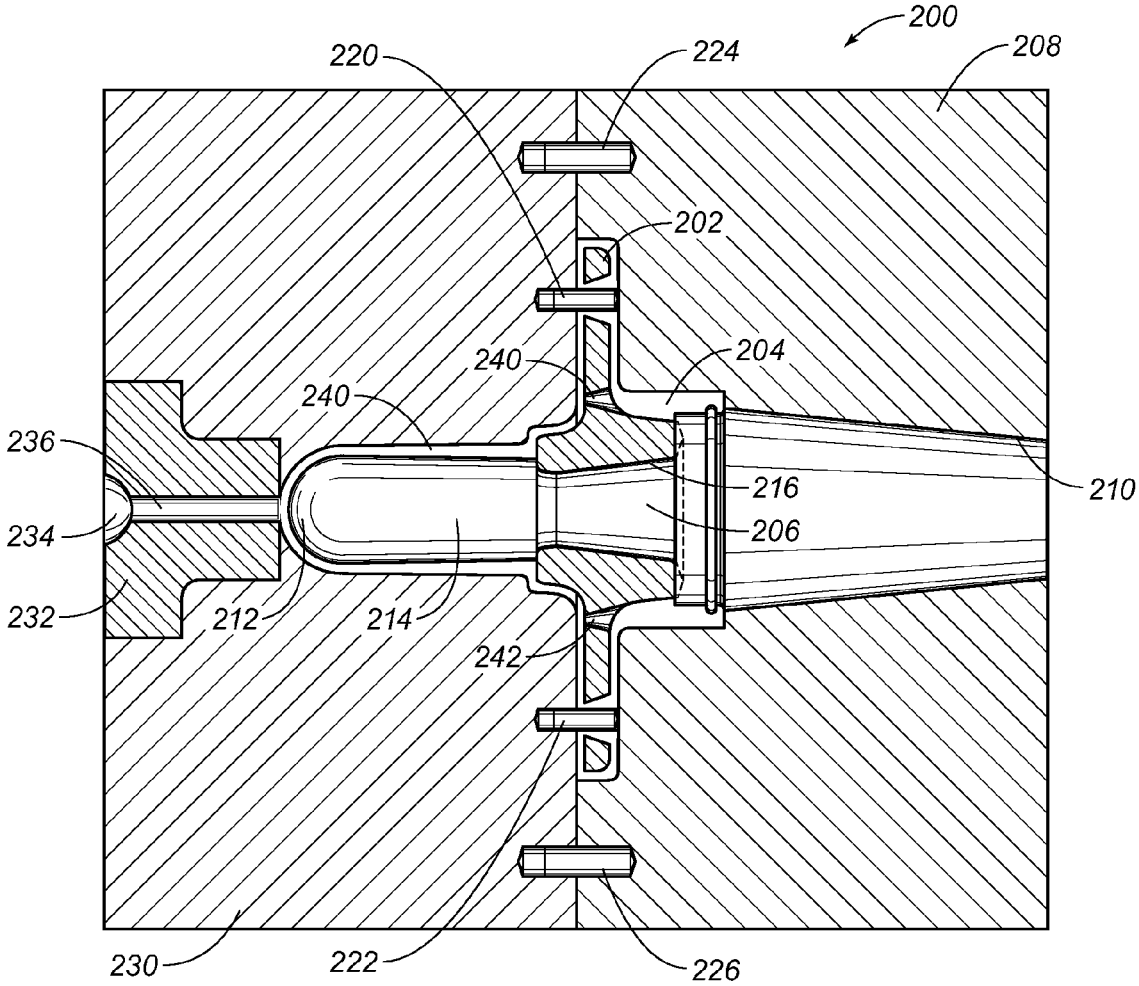
FIG. 7 is a cross-sectional view illustrating the manner in which the encapsulation is formed around the anchor and through the holes.

The present invention is also an improved method of encapsulating a tendon tensioning anchor. FIG. 7 illustrates the method of the present invention. In FIG. 7, there is shown the complete mold 200 for the forming of the plastic encapsulation about the exterior of a standard tendon tensioning anchor 202. In the best mode of the present invention, this is a plastic injection molding process. Alternatively, however, the plastic encapsulation can be accomplished through the use of thermoplastic injection molding or by thermoset injection processes. These other techniques, importantly, will incorporate a similar method of the present invention.

Initially, anchor 202 is loaded into the mold 200. The interior 204 of mold 200 defines the exterior shape of the plastic encapsulation. The anchor 202 is initially placed into position by sliding onto and centering upon mandrel 206. Mandrel 206 extends through the right-hand side 208 of mold 200. Mandrel 206 has a downwardly tapered wall 210 extending through mold half 208. Mandrel 206 extends outwardly to end 212. End 212 has a semi-spherical shape. Mandrel 206 has a solid cylindrical portion 214 from end 212. A tapered area 216 follows this cylindrical section 214. This tapered section 216 matches the taper and size of the inner diameter of the anchor 202.

After placing anchor 202 upon the mandrel 206, the anchor is secured in position by the appropriate placing of pins 220 and 222 in proper position. These pins 220 and 222 secure the anchor 202 in position with reference to the mold half 208. Additionally, pins 224 and 226 are inserted into their respective openings within mold half 208. Following the alignment of these pins and the proper positioning of the anchor 202, mold half 230 is placed in close juxtaposition and properly secured against mold half 208. In this configuration, the mold for the forming of the plastic encapsulation about anchor 202 is in proper condition.

Mold half 230 includes bushing 232. Bushing 232 has injection nozzle 234 extending therethrough. Injection nozzle 234 is positioned so as to communicate with the interior plastic encapsulation-forming area of the mold 200. The injection nozzle 234 allows liquid plastic to flow through opening 236 into the mold 200.

So as to form the plastic encapsulation, a liquid polymer is injected into nozzle 234, passes through opening 236, and flows into the form 240. When the liquid polymer passes into the form 240, it spreads through the open areas defined by the mold. In essence, this spreading allows the liquid polymer to cover the exterior surfaces of anchor 202. The liquid polymer is injected under high pressures. The polymer is high-density polyethylene. Under the preferred embodiment of the present invention, this high-density polyethylene is injected at 15,000 p.s.i. of injection pressure. This level of pressure eliminates the air pockets between the polymer encapsulation and the base member. It is important to note, however, that depending upon the process used for the injection and the encapsulating of the anchor, less pressure may be utilized or more pressure may be utilized in addition, the encapsulation could also be formed by vacuum technology or casting methods. It was felt important to eliminate the air pockets between the encapsulation and the anchor and to keep the layers in relatively air-tight juxtaposition. In one embodiment, this 7,500 to 15,000 p.s.i. of injection pressure was found suitable for such purpose.

It can be seen that the liquid polymer flows around the semi-spherical area of mandrel 206, through the passageways and toward the open area 204 so as to define the receiving area. The liquid polymer flow around the semi-spherical portion 212 and solid cylindrical portion 214 and forms the tubular portion of the encapsulation. The filling of the area 204 forms the receiving area of the anchor of the present invention.

The injected polymer is allowed to solidify within the mold in the desired format. When the polymer solidifies, it tightens and securely covers the base member/anchor. Following solidification, the anchor is removed from the mold. After it is removed from the mold, the semi-spherical polymer portion, formed during the molding process over the end of the tubular section of the anchor, is trimmed so as to open the end of the tubular portion. After removal and trimming, the tendon tensioning anchor of the present invention is in proper condition for use.

In FIG. 7, it can be seen that the holes 240 and 242 are formed through the respective flanges of the anchor 202. When the polymeric material is injected under pressure, it will flow through the holes 240 and 242 so as to establish an integral connection with the polymeric material on opposite sides of the respective flanges of the anchor. Unlike the pins 220 and 222 which serve to close the nail holes during injection molding, the holes 240 and 242 are open to the free flow of polymer therethrough. As such, the polymer is able to completely and entirely fill these holes so as to establish a strong connection with the polymeric surfaces overlying flanges of the anchor 202.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A tendon tensioning anchor comprising:

a base member having a tubular section extending therefrom, said tubular section having a sloping annular interior wall suitable for receiving a tendon therein, said base member having a first flange and a second flange extending outwardly on opposite sides of said tubular section, said first flange having at least a pair of holes formed therein in which one of the pair of holes is adjacent said tubular section, said second flange having at least a pair of holes formed therein in which one of the pair of holes of said second flanges is adjacent said tubular section; and a polymeric encapsulation in generally air-tight juxtaposition with an exterior of said base member, said polymeric encapsulation having a first surface on one side of each of said first and second flanges and a second surface on an opposite side of each of said first and second flanges, said polymeric encapsulation extending through and filling the holes adjacent said tubular section so as to integrally connect said first and second surfaces, the holes adjacent said tubular section being tapered so as to have a narrow diameter at said first surface and a wide diameter at said second surface.

2. The anchor of claim 1, the holes adjacent said tubular section being diametrically opposite each other.

3. The anchor of claim 1, said polymeric encapsulation having a tubular portion extending around an exterior of said tubular section.

4. The apparatus of claim 1, said polymeric encapsulation being a polymeric material in injection-molded relationship with said base member, said polymeric encapsulation being of a unitary construction.

5. A post-tension anchor system comprising:

a tendon having an end;

a base member receiving said end of said tendon therein, said base member having a tubular section extending therefrom, said tubular section having a sloping annular interior wall suitable for receiving said tendon therein, said base member having a first flange and a second flange extending outwardly on opposite sides of said tubular section, said first flange having at least a pair of holes formed therein in which one of the pair of holes is adjacent said tubular section, said second flange having at least a pair of holes formed therein in which one of the pair of holes of said second flanges is adjacent said tubular section; and a polymeric encapsulation in generally air-tight juxtaposition with an exterior of said base member, said polymeric encapsulation having a first surface on one side of each of said first and second flanges and a second surface on an opposite side of each of said first and second flanges, said polymeric encapsulation extending through and filling the holes adjacent said tubular section so as to integrally connect said first and second surfaces, the holes adjacent said tubular section being tapered so as to have a narrow diameter at said first surface and a wide diameter at said second surface.

6. The system of claim 5, said polymeric encapsulation being a polymeric material in injection-molded relationship to said base member, said polymeric encapsulation being of a unitary construction.

7. The system of claim 6, further comprising:

a cap affixed to an end of said tubular section of said polymeric encapsulation so as to cover said end of said tendon in generally liquid-tight relationship therein.

* * * * *